United States Patent [19]

Morris et al.

[11] Patent Number: 4,673,479

[45] Date of Patent: Jun. 16, 1987

[54] FABRICATED ELECTROCHEMICAL CELL

[75] Inventors: Gregory J. E. Morris, Lake Jackson; Sandor Grosshandler, Houston; Richard N. Beaver, Angleton; John R. Pimlott, Sweeny; Hiep D. Dang, Lake Jackson, all of Tex.

[73] Assignee: The Dow Chemical Company, Midland, Mich.

[21] Appl. No.: 682,735

[22] Filed: Dec. 17, 1984

Related U.S. Application Data

[63] Continuation-in-part of Ser. No. 472,792, Mar. 7, 1983, Pat. No. 4,488,946.

[51] Int. Cl.[4] ..... C25B 1/26

[52] U.S. Cl. ..... 204/279; 204/252; 29/592 R; 29/825

[58] Field of Search ..... 29/592 R, 825, DIG. 1, 29/DIG. 5; 228/193; 204/98, 128, 254–256, 268, 279, 286, 297 R

[56] References Cited

U.S. PATENT DOCUMENTS

| | | | |
|---|---|---|---|
| 3,752,757 | 8/1973 | Stephenson, III et al. | 204/256 |
| 3,788,966 | 1/1974 | Stephenson, III et al. | 204/256 |
| 3,859,197 | 1/1975 | Bouy et al. | 204/284 |
| 3,948,750 | 4/1976 | Figueras et al. | 204/286 |
| 3,950,239 | 4/1976 | Figueras | 204/254 |
| 3,960,698 | 6/1976 | Bortak | 204/254 |
| 4,017,375 | 4/1977 | Pohto | 204/255 |
| 4,040,934 | 8/1977 | Hoekje et al. | 204/256 |
| 4,105,515 | 8/1978 | Ogawa et al. | 204/98 |
| 4,108,742 | 8/1978 | Seko et al. | 204/98 |
| 4,111,779 | 9/1978 | Seko et al. | 204/255 |
| 4,116,805 | 9/1978 | Ichisaka et al. | 204/254 |
| 4,116,807 | 9/1978 | Peters | 204/290 F |
| 4,137,145 | 1/1979 | Wallace | 204/254 |
| 4,141,815 | 2/1979 | Ichisaka et al. | 204/254 |
| 4,149,952 | 4/1979 | Sato et al. | 204/258 |
| 4,155,820 | 5/1979 | Ogawa et al. | 204/98 |
| 4,178,218 | 12/1979 | Seko | 204/98 |
| 4,194,670 | 3/1980 | Ichisaka et al. | 228/179 |
| 4,202,743 | 5/1980 | Oda et al. | 204/98 |
| 4,242,185 | 12/1980 | McRae | 204/98 |
| 4,247,376 | 1/1981 | Dempsey et al. | 204/128 |
| 4,279,731 | 7/1981 | Pellegri | 204/254 |
| 4,294,671 | 10/1981 | Balko | 204/128 |
| 4,339,322 | 7/1982 | Balko et al. | 204/255 |
| 4,340,452 | 7/1982 | deNora | 204/129 |
| 4,357,218 | 11/1982 | Seko | 204/98 |
| 4,381,230 | 4/1983 | Burney, Jr. et al. | 204/98 |
| 4,444,639 | 4/1984 | Schurig et al. | 204/257 |
| 4,444,641 | 4/1984 | Oda et al. | 204/286 |
| 4,448,662 | 5/1984 | DuBois et al. | 204/252 |
| 4,457,815 | 7/1984 | Levin | 204/98 |
| 4,457,822 | 7/1984 | Asano et al. | 204/252 |
| 4,457,823 | 7/1984 | LaConti et al. | 204/282 |
| 4,464,292 | 8/1984 | Boulton | 204/253 |

FOREIGN PATENT DOCUMENTS

| | | | |
|---|---|---|---|
| 1072054 | 2/1980 | Canada | 204/254 |
| 0007078 | 1/1980 | European Pat. Off. | 204/254 |
| 0075401 | 3/1983 | European Pat. Off. | 204/254 |
| 0080288 | 6/1983 | European Pat. Off. . | |
| 2025462 | 1/1980 | United Kingdom | 204/254 |

OTHER PUBLICATIONS

Kaufmann, Dale W., Chapter 10, pp. 201–203, *Sodium Chloride The Production and Properties of Salt and Brine*, Copyright 1960 by Reinhold Publishing Corporation, New York.

Mitchell, D. R. and Kessler, H. D., "The Welding of Titanium to Steel", reprinted from *Welding Journal*, Dec. 1961.

*Primary Examiner*—Terryence Chapman

[57] ABSTRACT

The invention is an electrolytic unit comprised of a plurality of parts connected in a manner to form a substantially planar electrolytic unit comprising:

a central support element component, a plurality of bosses on each side of the support component projecting outward from said support component;

a peripheral flange structure composed of at least one piece and having an internal surface which sealably receives and attached to at least a portion of the external peripheral surfaces of the support unit.

19 Claims, 4 Drawing Figures

FABRICATED ELECTROCHEMICAL CELL

CROSS REFERENCE TO RELATED APPLICATION

This application is a continuation-in-part of copending application Ser. No. 472,792 filed Mar. 7, 1983 now U.S. Pat. No. 4,488,946.

The present invention is related to an electrolytic unit fabricated from a plurality of parts assembled in a unique way. A plurality of such units positioned in operable combination are particularly useful in the production of chlorine and caustic.

BACKGROUND OF THE INVENTION

As used herein "electrolytic cell" means an assembly which at least includes an anode in an anode compartment and a cathode in a cathode compartment, wherein the anode compartment and the cathode compartment are separated by an ion exchange active membrane.

"Electrolytic unit" means an assembly which at least includes two electrode components separated by a central support element. The electrode components in an electrolytic unit may be oppositely charged, as is the case in a bipolar unit, or similarly charged, as is the case of a monopolar unit. Thus, monopolar units could be either cathode units or anode units.

"Electrode component" means an electrode or an element associated with an electrode such as a current distributor grid or current collector. The component may be in the form of a wire mesh, woven wire, punched plate, metal sponge, expanded metal, perforated or unperforated metal sheet, flat or corrugated lattice work, spaced metal strips or rods, or other forms known to those skilled in the art.

Chlorine and caustic are large volume, basic chemicals which are most frequently produced electrolytically from an aqueous solution of an alkali metal chloride in electrolytic cells. Recently, a variety of technological advances have occurred to minimize the gap between the anode and the cathode of an electrolytic cell to minimize the electrical resistance of the electrolytic cell, thus allowing the electrolytic cell to operate more efficiently. Advances include such things as dimensionally stable anodes, ion exchange membranes, depolarized electrodes, zero gap cell configurations, and solid polymer electrolyte membranes.

There are two major types of electrolytic cells commonly used for the production of chlorine and caustic, i.e., monopolar cells and bipolar cells.

A bipolar electrolytic cell consists of several electrochemical units in a series, in which each unit, except the two end units, acts as an anode on one side and a cathode on the opposing side. Electrolytic units are sealably separated by an ion exchange active membrane, thereby forming an electrolytic cell, or series of electrolytic cells. Electrical energy is introduced into a terminal bipolar cell at one end of a series of bipolar cells, passes through the series of bipolar cells, and is removed from the terminal cell at the other end of the series. An alkali metal halide solution is fed into the anode compartment(s) where a halogen gas is generated at the anode. Alkali metal ions are selectively transported through the ion exchange active membrane(s) into the cathode compartment(s) where alkali metal hydroxides are formed.

Monopolar electrolytic cells comprise at least two terminal cells and a plurality of anode units and cathode units alternately positioned therebetween. The monopolar electrolytic units are separated by an ion exchange active membrane, thus forming a plurality of monopolar electrolytic cells. Each electrolytic unit is equipped with at least one inlet, through which electrolyte may be fed to the unit, and with at least one outlet, through which liquids and gases may be removed from the unit. Each electrolytic unit is electrically connected to a power supply. Power if fed to one monopolar electrolytic unit and is removed from at least one adjacent electrolytic unit.

To take advantage of the new technological advances, a variety of electrolytic unit designs have been proposed. However, many of these are quite complicated and require the use of expensive materials. An uncomplicated electrolytic unit employing readily available, inexpensive materials would be highly desirable. It is the object of this invention to provide such an electrolytic unit.

SUMMARY OF THE INVENTION

The invention is an electrolytic unit comprised of a plurality of parts connected in a manner to form a substantially planar electrolytic unit comprising:

- a central support element component, a plurality of bosses on each side of the support component projecting outward from said support component;
- a peripheral flange structure composed of at least one piece and having an internal surface which sealably receives and attached to at least a portion of the external peripheral surfaces of the support unit.

The bosses are preferably spaced apart in a fashion to rigidly support the electrode components. The frequency of bosses, whether of round cross section or of elongated or rib-type cross section, per unit area of the flat electrode elements associated therewith may vary within ample limits.

The invention also includes a method for making the electrolytic unit by assemblying at least three types of parts, i.e. peripheral flange structure, bosses, a central support element. Opposing sides of the so formed electrolytic unit may be flattened prior to, during, or after complete assembly of said parts if needed. A liner is then applied to at least a portion of at least one side of said assembled, electrolytic unit.

The electrolytic unit of the present invention may be designed and used as either a monopolar unit or a bipolar unit.

BRIEF DESCRIPTION OF THE DRAWINGS

The invention can be better understood by reference to the drawings illustrating the invention and wherein like reference numerals refer to like parts in the different drawing figures, and wherein.

DETAILED DESCRIPTION OF A PREFERRED EMBODIMENT OF THE INVENTION

Figure 1:
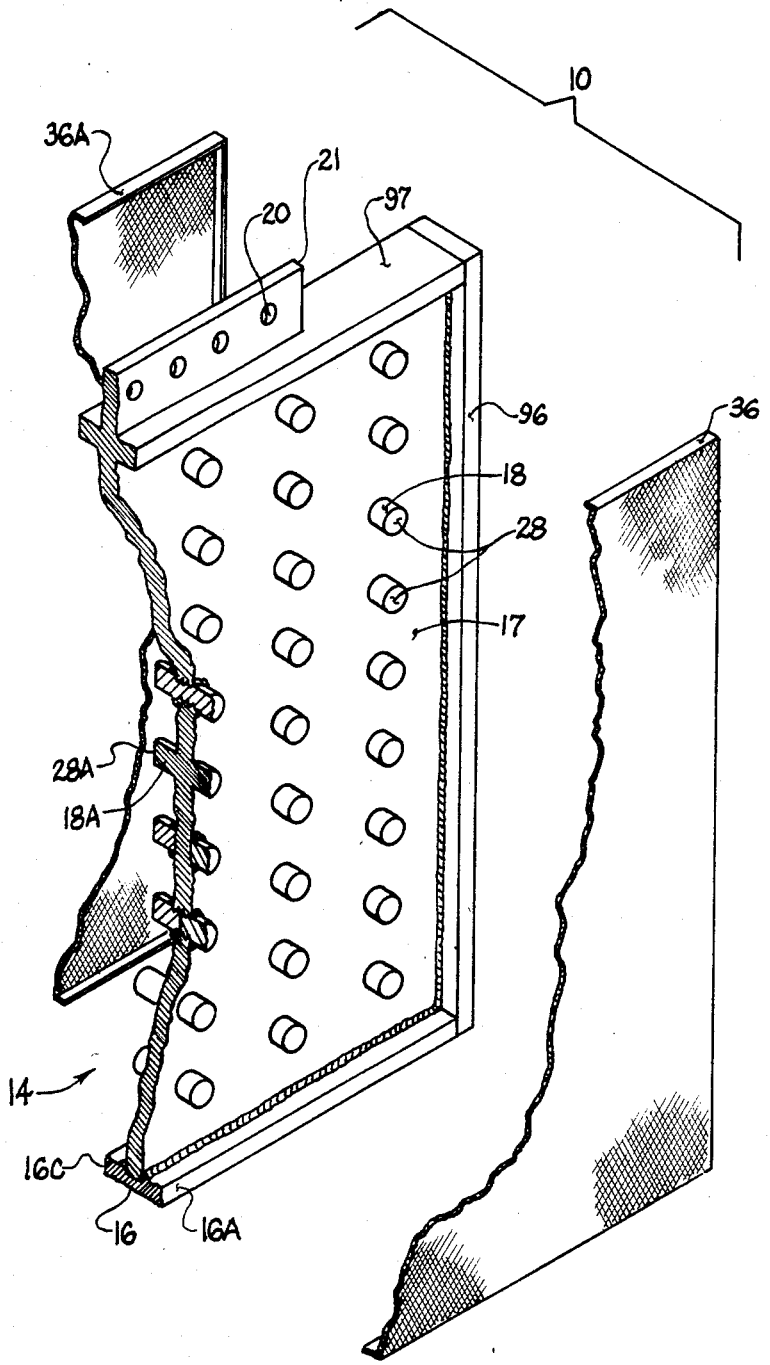
FIG. 1 is an exploded, partially broken away perspective view of one embodiment of the electrolytic unit of the present invention.

The present invention uses a central support element 17 as one component of the assembled unlined electrolytic unit 10 and lined electrolytic unit 11. Preferably, the central support element 17 has sufficient structural integrity to provide a support for bosses 18 and 18A, peripheral flange structures 16, 96, and 97, and for a liner 26 or 26A, if a liner is to be used. The central support element 17 is substantially more massive and more rigid than the liner 26 or 26A and any electrode components 36, 36A, 46, or 46A normally used in electrolytic cells.

The central support element 17 may be made from a variety of materials which meet the requirements outlined above. Preferably, however, the material is selected from the group consisting of iron, grey iron and malleable iron, ductile iron, steel, stainless steel, nickel, aluminum, molybdenum, copper, magnesium, lead, alloys of each and alloys thereof.

More preferably, the central support element 17 is constructed from a material selected from the group consisting of ferrous materials. Ferrous materials are materials whose primary constituent is iron. Most preferably, the central support element 17 is constructed from ductile iron because of its stability, low cost and the ready availability of ductile iron with very accurate dimensions.

In those cases where the unlined electrolytic unit 10 or lined electrolytic unit 11 is used as a bipolar electrolytic unit, the bosses 18 and 18A should be sufficiently conductive to transmit electrical energy through its mass, or portions of its mass, in a direction perpendicular to the planar central element 17. The electrical conduction occurs through the bosses 18 and 18A, rather than through the mass of the central support element 17 except in the case where the bosses 18 and 18A are offset, then the central element must be sufficiently conductive to transmit electrical energy through its mass, or portions of its mass.

In those cases where the unlined electrolytic unit 10 or lined electrolytic unit 11 is used as a monopolar electrolytic unit, the central support element 17 should be sufficiently conductive to transmit electrical energy throughout substantially its entire mass. This allows an electrical connection from a power source to be connected to its peripheral edges or to a point on the central support element 17 itself and distribute the electrical energy to the various points of an electrode component in electrical contact with the central support element 17.

Regardless of whether the central support element 17 is used as a monopolar unit or as a bipolar unit, it is possible to construct the central support element 17 from materials that are readily available, and generally inexpensive without having to be overly concerned with the resistivity of the material. This is possible because of the large mass and cross sectional area of the central support element 17. The central support element 17 has a sufficiently large cross sectional area to minimize its electrical resistance. The fact that the central support element 17 has a large cross sectional area allows the use of materials having a higher resistivity than could be used in configurations of the prior art. Thus, materials such as iron, steel, ductile iron and grey iron and malleable iron are perfectly suitable for use in the present invention. More specifically, materials having a resistivity as high or higher than copper may be economically used to form the central support element 17. More economically, materials having a resistivity greater than about 10 micro-ohms-cm may be used. Most economically, materials having resistivities as high as, or higher, than about 50 micro-ohms-cm may be used.

When the unlined electrolytic unit 10 or lined electrolytic unit 11 of the present invention is used as a monopolar electrolytic unit, the central support element 17 may have one or more lined passageways connecting opposite sides thereof. The passageways allow electrolyte or gases to pass from one side of the central support element 17 to the other side. The central support element 17 preferably contain passageways which occupy no more than about 60 volume percent of the total volume of the central support element 17. The openings allow less metal to be used in forming the central support element, thus making the cell more economical. In addition, openings can be spaced to direct current to certain portions of the cell.

A plurality of bosses 18 and 18A are attached on opposing sides of the central support element 17. These bosses 18 and 18A project a predetermined distance outwardly from the central support element 17 into an area that will ultimately become an electrolyte compartment, when a plurality of unlined electrolytic unit 10 or lined electrolytic unit 11 are assembled to form a plurality of electrolytic cells. These bosses 18 and 18A are capable of being electrically connected either directly to an electrode component 36, 38A, 46, or 46A, or indirectly to an electrode component 36, 36A, 46, or 46A through a liner. Preferably the ends of the bosses 18 and the ends of the bosses 18A lie in the same geometrical plane, respectively. This can be assured during a flattening step, in needed, of the assembly process of the electrolytic units of the present invention. The details of the assembly process are discussed later. Preferably, the bosses 18 and 18A are substantially solid. They may, however, contain internal voids, as a result of casting.

The bosses 18 and 18A may be positioned in a back-to-back relationship with each other across the central support element 17. Optionally, they may be offset from each other across the central support element 17. They may be positioned in a variety of other cross sectional configurations from each other.

The bosses 18 and 18A may be made from the same material as the material used for the central support element 17. Optionally, the bosses 18 and 18A may be made from a material different from that used to construct the central support element 17.

Preferably, the bosses 18 and 18A are made from a material selected from the group consisting of iron, grey iron and malleable iron, ductile iron, steel, stainless steel, molybdenum, nickel, aluminum, copper, magnesium, lead, alloys of each and alloys thereof.

More preferably, the bosses 18 and 18A are constructed from a material selected from the group consisting of ferrous materials. Ferrous materials are materials whose primary constituent is iron. Most preferably, the bosses 18 and 18A are constructed from ductile iron because of its stability, low cost and ready availability.

The bosses 18 and 18A are preferably spaced apart in a fashion so they can rigidly support any electrode components 36, 36A, 46, or 46A desired for use in the electrolytic cell. The distance between the bosses on each side of the central support element will generally depend upon the plane resistivity of the particular electrode element used. For thinner and/or highly resistive electrode elements, the spacing of the bosses 18 and 18A will be less, thus providing a more dense multiplicity of points for electrical contact. For thicker and/or less resistive electrode components 36, 36A, 46, or 46A, the spacing of the bosses 18 and 18A may be greater. Normally the spacing between the bosses 18 and 18A is within 5 and 30 centimeters although small and larger spacing may be used in accordance with the overall design considerations.

Figure 2:
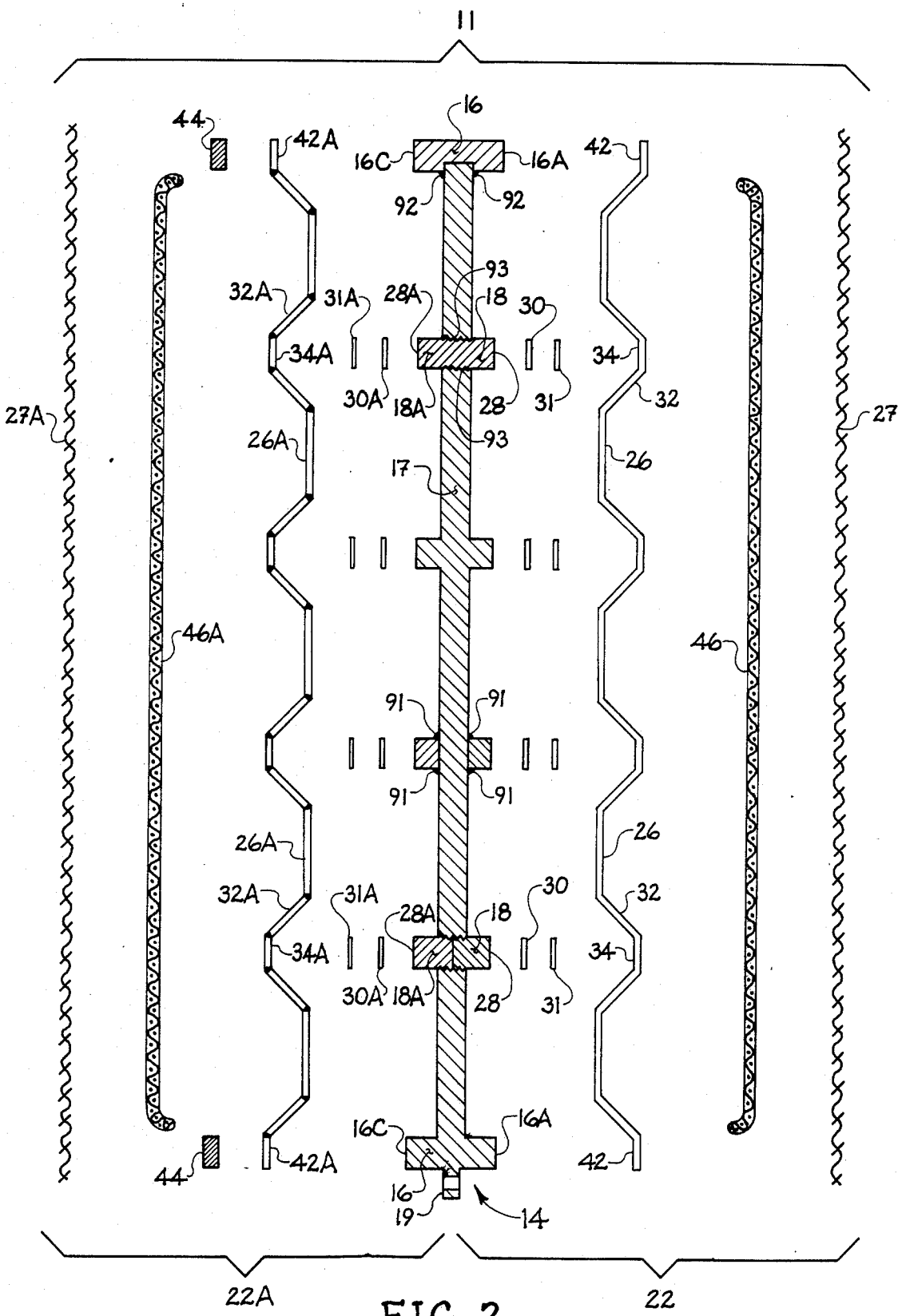
FIG. 2 is an exploded, sectional side view of one embodiment of the invention shown in FIG. 1.
Figure 3:
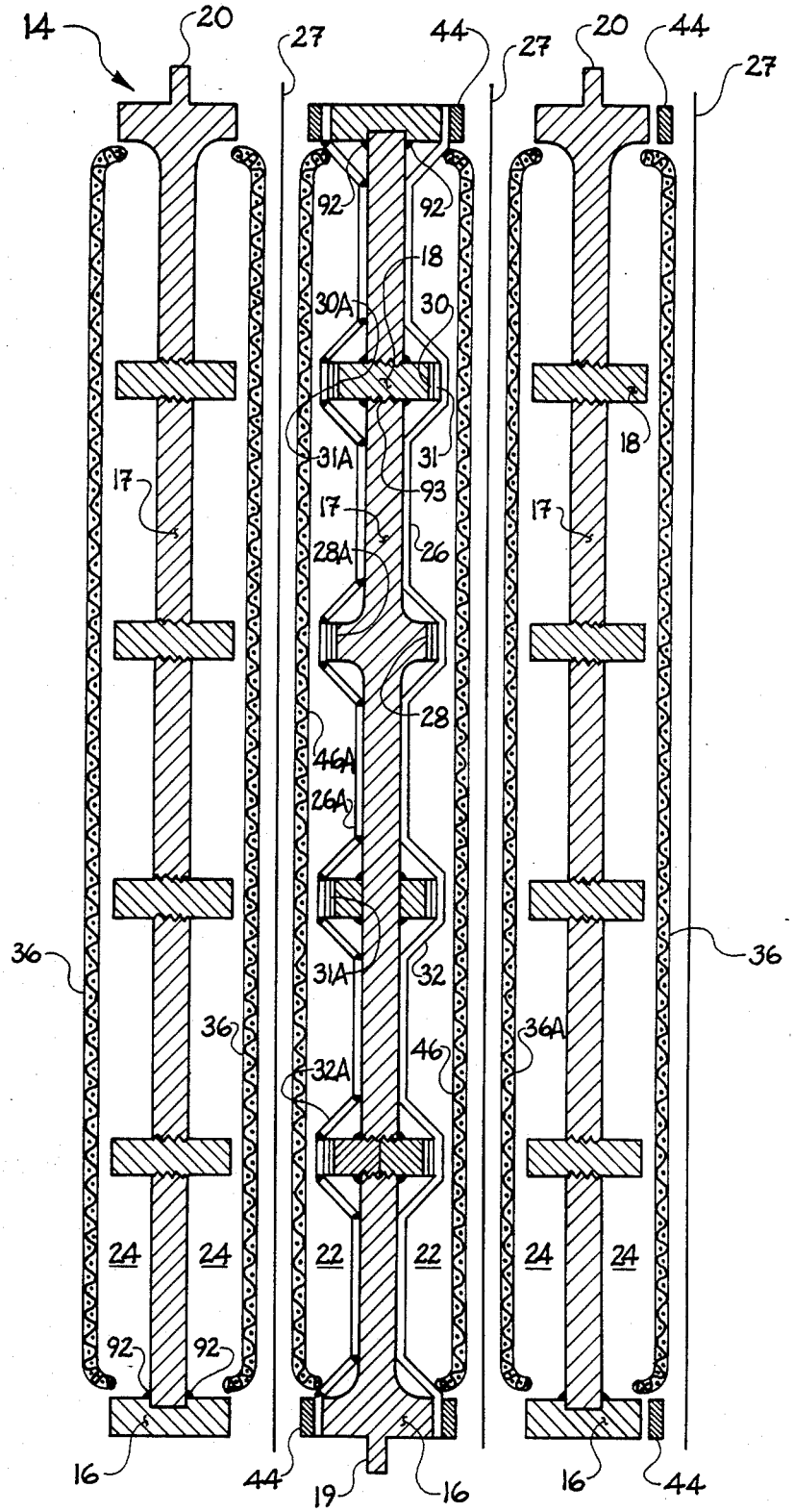
FIG. 3 is a cross-sectional side view of a plurality of electrolytic units positioned in operable combination, forming a series of electrolytic cells.
Figure 4:
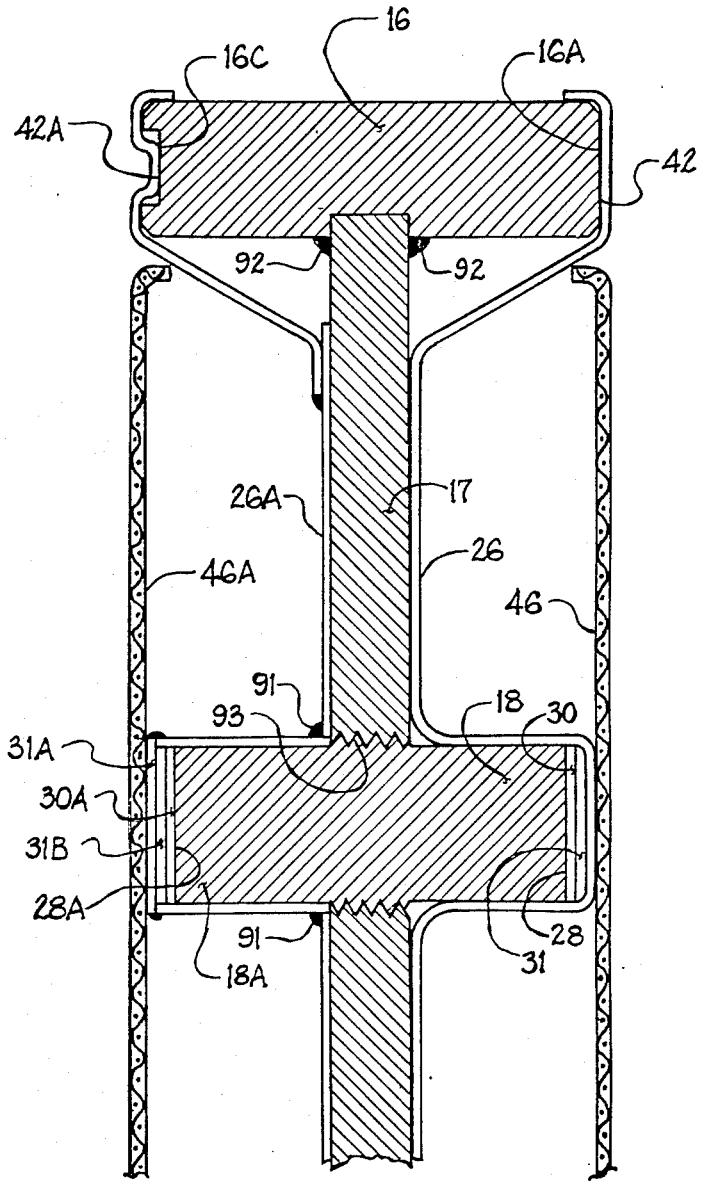
FIG. 4 is a cross-sectional side view of an electrolytic unit having the liner made from a plurality of pieces.

The bosses may be conveniently welded or bonded to the central support element 17 or they may be screwed into the central support element 17, as is shown in FIGS. 2 and 3 as means 93. Either way, it is desirable to make the attachment such that the electrical contact between the central support element 17 and the bosses is maximized. In the case of the unlined electrolytic unit 10 or in the case where only one liner is used it is preferable that the bosses are welded, even though they are screwed into or bonded to the central support element 17. In the case of the lined electrolytic unit 11, it is preferable that the bosses not be welded, but could contain a tack weld.

The bosses have a surface 28 and 28A which is machined flattened prior to, during, or after the assembly of the unit. These surfaces are adapted to be attached to a liner, intermediate coupons (30, 30A, 31 or 31A), or to an electrode component.

Surrounding the peripheral edges of the central support element 17 is a peripheral flange structure. It is a window-frame structure having a thickness greater than, or at least equal to, the thickness of a boss-containing central support element 17. Preferably the peripheral flange structure extends further from the plane of the central support element 17 than do the ends of the bosses 18 and 18A. This provides a space for electrode components 36, 36A, 46, or 46A that will be present when the unlined electrolytic unit 10 or lined electrolytic unit 11 of the present invention are stacked adjacent to each other in operable combination. Preferably the thickness of the peripheral flange structure is at least about 2–6 times greater than the thickness of the central support element 17. More preferably, the peripheral flange structure is about 60–70 millimeters thick when the central support element 17 is about 20–25 millimeters thick.

The peripheral flange structure 16, 96, and 97 may be made from a variety of materials which meet the requirements outlined above. The materials may be the same or different from the material used to form the central support element 17. If the materials are different, preferably, the different materials are weldably compatible. Preferably, however, the material is selected from the group consisting of iron, grey iron and malleable iron, ductile iron, steel, stainless steel, nickel, aluminum, copper, molybdenum, magnesium, lead, alloys of each and alloys thereof.

More preferably, the peripheral flange structure 16, 96, and 97 is constructed from a material selected from the group consisting of ferrous materials. Ferrous materials are materials whose primary constituent is iron. Most preferably, the peripheral flange structure 16, 96, and 97 is constructed from ductile iron because of its stability, low cost and ready availability.

The peripheral flange structure 16, 96, and 97 may be a single, picture frame type structure or it may be a plurality of pieces joined together to form a complete covering around the peripheral edges of the central support element 17. It is thicker than the central support element 17. However, it lies in approximately the same plane as do the ends of the bosses 18 and 18A after they have been attached to the central support element 17 and flattened. Preferably, the peripheral flange structures 16, 96, and 97 and the central support element 17 are made from materials that are weldably compatible. If it is composed of pieces, it may be attached to the central support element 17 before or after the bosses 18 and 18A are attached to the central support element 17. The combination may be flattened before or after the peripheral flange structures 16, 96, and 97 are attached to the central support element 17, if needed.

If the electrolytic unit is to be used as a bipolar electrolytic unit, the peripheral flange structure 16 need not be made from an electrolytically conductive material, because it will not need to conduct electricity. However, if the electrolytic unit is to be used as a monopolar electrolytic unit, the peripheral flange structure 16, 96, and 97 is preferably electrically conductive. This provides a convenient means to transmit electrical energy into and out of the various unlined electrolytic units 10 or lined electrolytic units 11 present in an operating series of unlined electrolytic units 10 or lined electrolytic units 11. Less preferably, the peripheral flange structure 16, 96, and 97 is made from an electrically non-conductive material and passageways pass through it to provide a pathway for elements to pass through the peripheral flange structure 16, 96, and 97 to conduct electrical energy into and out of the monopolar unlined electrolytic unit 10 or lined electrolytic unit 11.

The peripheral structures, if not formed as a one piece body with the central support element 17, are preferably firmly attached to the central support element 17. This firm attachment assures the dimensional stability of the electrolytic units and maintains the desired gap between electrode components of adjoining electrolytic units. Preferably, the peripheral structures are attached to the central support element 17 by welding.

When the electrolytic unit is to be used as a bipolar unit, and the unit is not lined, it is particularly important to sealably weld the peripheral structures to the central support element to minimize the flow of fluids from one side of the central support element to the other side.

When a plurality of unlined electrolytic units 10 or lined electrolytic units 11 are assembled in operable combination, an ion exchange active membrane 27 and 27A is positioned between adjoining unlined electrolytic units 10 or lined electrolytic units 11. The ion exchange active membrane 27 and 27A is used between both bipolar and monopolar unlined electrolytic units 10 or lined electrolytic units 11. In either case, the ion exchange active membrane 27 and 27A will be separating an electrode compartment from an electrode compartment.

The ion exchange active membrane 27 and 27A suitable for use with the present invention may contain a variety of ion exchange active sites. For example, they may contain sulfonic or carboxylic acid ion exchange active sites. Optionally, the ion exchange active membrane 27 and 27A may be bi-layer membranes and have one type of ion exchange active site in one layer and another type of ion exchange active sites in the other layer. The membranes may be reinforced to impair deforming during electrolysis or they may be unreinforced to maximize the electrical conductivity through the membrane.

The ion exchange membrane may preferably contain sulfonic ion exchange groups, carboxylic ion exchange groups, or both sulfonic acid carboxylic acid ion exchange groups. Optionally, the ion exchange membrane may be a bi-layer membrane having one type of ion exchange active sites in one layer and another type of ion exchange active sites in the other layer. The membrane may be reinforced to impair deforming during electrolysis or it may be unreinforced to maximize the electrical conductivity throughout the membrane.

Representative of the types of ion exchange active membrane 27 and 27A suitable for use in assemblying a plurality of unlined electrolytic units 10 or lined electrolytic units 11 are disclosed in the following U.S. Pat. Nos. 3,909,378; 4,025,405; 4,065,366; 4,116,888; 4,123,336; 4,126,588; 4,151,053; 4,176,215; 4,178,218; 4,192,725; 4,209,635; 4,212,713; 4,251,333; 4,270,996; 4,329,435; 4,330,654; 4,337,137; 4,337,211; 4,340,680; 4,357,218; 4,358,412; and 4,358,545. These patents are hereby incorporated by reference for the purpose of the membranes they disclose.

It is within the scope of this invention for the electrolytic cells formed when a plurality of the unlined electrolytic units 10 or lined electrolytic units 11 of the present invention are positioned in operable combination to be a multi-compartment electrolysis cell using more than one ion exchange active membrane 27 and 27A, e.g., a three compartment cell with two ion exchange active membrane 27 and 27A spaced apart to form a compartment between them as well as the compartment formed on the opposite side of each membrane between each membrane and its respective adjacent electrode component.

Additionally, other electrode elements may be used in conjunction with components. Such elements include current collectors, spacers, mattresses and other elements known to those skilled in the art. Special elements or assemblies for zero gap configurations or solid polymer electrolyte membranes may be used. Also, the units of the present invention may be adapted for a gas chamber for use in conjunction with a gas-consuming electrode, sometimes called a depolarized electrode. The gas chamber is required in addition to the liquid electrolyte compartments. A variety of cell elements which may be used in the present invention are well known to those skilled in the art and are shown in a variety of patents, for example, U.S. Pat. Nos. 4,457,823; 4,457,815; 4,444,623; 4,340,452; 4,444,641; 4,444,639; 4,457,822; and 4,448,662.

A preferred method of integrally forming the central support element is by sand casting molten metal, preferably casting molten ferrous metal. Other methods of forming this central support element are, of course, not excluded. For example, other methods of forming the central cell element include die casting, powdered metal pressing and sintering, hot isostatic pressing, hot forging, and cold forging.

Furthermore, it is within the scope and spirit of forming this central support element to utilize such metal forming techniques as the use of inserts, chills, and cores in the integral formation of this central cell unit. In fact, the particular location of chills of particular metals has resulted in the surprising result of not only making a more uniform casting but simultaneously producing a central cell element with better electrical conductive properties. In so doing, these chills then turn into inserts, of course.

For certainty of definition, the meaning of chills, inserts and cores in metal structure forming will now be given as these terms are used by the present inventors. Chills are items placed in the mold which act as aids in casting the part. Their primary purpose is to control the cooling rate of the molten metal at specific locations in the mold. By controlling the cooling of the molten metal, metal shrinkage can more accurately be controlled thereby improving part quality through reduced imperfections and defects. Chills may or may not become an integral part of the casting and may, in some cases, act as inserts as well.

Inserts are those items placed in the mold to aid in the function of the mold; aid in the forming of the part; or which will become a functional part of the finished article. They retain their identify, to varying degrees, after the formation is complete. They are usually metallic, although any suitable material may be used. Inserts may, in some cases, act as chils as well.

Cores are items placed in the mold which serve to eliminate metal in unwanted areas of a casting. Cores are used in the mold where it would be impractical or impossible to form the mold in such a way as to eliminate the unwanted metal. A typical example would be a core used to create the internal cavity of a cast metal valve body. Cores may, in some cases, act as chills as well.

The particularly useful chills which turn into inserts to increase the electrical conductivity of the central support element are located transversely to the central barrier and run into the bosses. The central barrier and bosses of the central support element will be discussed below. Suffice it for now to say that the preferred inserts or chills used are made of a solid metal that has the bulk of the metal of the central support element formed around them. Preferably the metal formed around them is formed by casting in a molten state in a sand mold.

It may be advantageous to have openings passing all the way through the central support element in a monopolar cell unit to improve circulation while such cores would be of no significant disadvantage in a bipolar cell unit so long as the central support element has at least one liner on one of its sides to prevent the mixing of anolyte or catholyte from the adjacent bipolar compartments.

If desired, a liner 26 or 26A may be positioned over the area of the unlined electrolytic unit 10 which will be contacted with corrosive environments when the unlined electrolytic unit 10 is used in electrolytic processes. Optionally, the peripheral flange structures 16, 96, and 97 may also be lined, even though they may not be exposed to a corrosive environment. Optionally, a liner 26 or 26A may be positioned on both sides of the unlined electrolytic unit 10 of the present invention.

The liner 26 or 26A for each side may be one piece or it may be a plurality of pieces bonded together. Liner 26 is shown as a one piece liner, while liner 26A is shown as a plurality of pieces. A one piece liner is preferred because it minimizes the possibility of leaks, allowing fluids to contact the central support element 17. Preferably the liner is of a thickness sufficient to be substantially completely hydraulically impermeable.

One piece liners are preferably formed with a minimum of stresses in them to minimize warpage. Avoiding these stresses in the liner may be accomplished by hot forming the liner in a press at an elevated temperature of about 900° F. to about 1300° F. Both the liner metal and a metal press are heated to this elevated temperature before pressing the liner into the desired shape. The liner is held in the heated press and cooled under a programmed cycle to prevent formation of stresses in it as it cools to room temperature.

Liners 26 or 26A suitable for use in chloralkali cathode compartments are preferably selected from the group consisting of ferrous materials, nickel, stainless steel, chromium, monel and alloys thereof.

Liners 26 or 26A suitable for use in chloralkali anode compartments are preferably selected from the group consisting of titanium, vanadium, tantalum, columbium, hafnium, zirconium, and alloys thereof.

The liner 26 or 26A may be coextensive with only the portion of the central support element 17 containing the bosses 18 and 18A, or it may be coextensive with the entire length and width of the entire central support element 17 and the peripheral flange structures 16, 96, and 97.

To assure the maximum physical and electrical contact between the linerand the bosses, it is preferred for the liner to be welded to the ends of the bosses 18 and 18A Optionally, the liner can be welded not only at the ends of the bosses, but at various other places where the two contact each other. Capacitor discharge welding is a preferred welding techniques to be used to weld the liner to the bosses 18 and 18A.

For fluid sealing purposes between the membrane 27 or 27A, and sealing means surface 16A or 16C, it is preferred for liner 26 or 26A to be formed in the shape of a pan with an off-set lip 42 or 42A extending around its periphery. Lip 42 and 42A fits flush against the lateral face 16A or 16C of peripheral flange structure 16. The periphery of membrane 27 or 27A fits flush against liner lip 42, and a peripheral gasket 44 fits flush against the other side of the periphery of the membrane 27 or 27A. In a series of electrolytic units, the gasket 44 fits flush against the lateral face 42A of the liner 26A and flush against the lateral face 16C of the peripheral flange structure 16, 96, and 97 when there is no liner.

If the liners 26 and 26A are titanium and the central support element 17 is a ferrous material, they may be connected by resistance welding or capacitor discharge welding. Resistance or capacitor discharge welding is accomplished indirectly by welding the liners 26 and 26A to the ends 28 and 28A of the bosses 18 and 18A through vanadium wafers 30 or 30A. Vanadium is a metal which is weldably compatible with titanium and ferrous materials. Weldably compatible means that one weldable metal will form a ductile solid solution with another weldable metal upon the welding of the two metals together. Titanium and ferrous materials are not normally compatible with vanadium. Hence, vanadium wafers 30 and 30A are used as an intermediate metal between the ferrous bosses 18 and 18A and the titanium liners 26 and 26A to accomplish the welding of them together to form an electrical connection betwen liners 26 and 26A and the central support element 17 as well as to form a mechanical support means for the central support element 17 to supporting liners 26 and 26A.

Preferably, a second wafer 31 and 31A are used and placed between wafers 30 and 30A and the liners 26 and 26A. The second wafer is preferable because when only one wafer is used, it has been discovered that the corrosive materials contacting the liner during operation of the cell to produce chlorine and caustic seem to permate into the titanium-vanadium weld and corrode the weld. The corrosive materials also permeate into the body of the central support element 17 and corrode it. Rather than use a thicker pan, it is much more economical to insert a second wafer 31 and 31A. The second wafer 31 and 31A is preferably sufficiently thick to minimize the possibility of the corrosive materials permeating into the central support element.

To introduce reactants into the electrolytic cells formed when a plurality of unlined electrolytic units 10 or lined electrolytic units 11 are stacked in operable combination, a plurality of nozzles are preferably present in each unlined electrolytic unit 10 or lined electrolytic unit 11. Although a variety of designs and configurations may be used, a preferred design is as follows. A plurality of metallic nozzles are formed, for example by investment casting. The nozzle casting is then machined to the desired size. A number of slots are machined into each peripheral flange structure 16, 96, and 97 at a plurality of desired positions to receive the nozzles. The slots are of a size to correspond to the thickness of the nozzle to be inserted into the slot, to assure a seal when the elements of the electrolytic cell are ultimately assembled. If a liner 26 or 26A is used, it is cut to fit around the nozzle. The nozzle is preferably attached to the liner 26 or 26A, for example, by welding. The liner 26 or 26A-nozzle combination is then placed into the unlined electrolytic unit 10 or lined electrolytic unit 11. The liner 26 or 26A caps 32 or 32A are then welded to the central support element 17 bosses 18 and 18A.

When a plurality of unlined electrolytic unit 10 or lined electrolytic unit 11 are assembled adjacent to each other, gaskets 44 are preferably positioned between the unlined electrolytic unit 10 and lined electrolytic unit 11. The gaskets serve three main functions: sealing, electrical insulation and setting the electrode gap. There are a variety of suitable gasket 44 materials that may be suitably used, for example, most rubber gaskets 44.

Although only one gasket 44 is shown, the invention certainly encompasses the use of gaksets on both sides of membrane 27 or 27A.

Adjacent to the central support element 17, or the liner 26 or 26A, if liners 26 or 26A are used, is an electrode component 36, 36A, 46, or 46A. The electrode components 36, 36A, 46, or 46A may be attached to the liner 26 or 26A or central support element 17, or they may be merely pressed against the liner 26 or 26A or the central support element 17. Preferably, the electrode component is coextensive with the central support element 17 and does not extend into the peripheral flange structure 16, 96, and 97 area. Otherwise, it would be difficult to seal adjacent unlined electrolytic units 10 or lined electrolytic units 11 when they are placed in operable combination.

Electrode components are preferably foraminous structures which are substantially flat and may be made of a sheet of expanded metal perforated plate, punched plate or woven metallic wire. Optionally, the electrode components may be current collectors which contact an electrode or they may be electrodes. Electrodes may optionally have a catalytically active coating on their surface.

Electrode components may be welded to, or merely pressed against, the bosses or to the liner, if a liner is used. Preferably, the electrode components are welded because the electrical contact is better.

Additionally, other elements may be used in conjunction with components. Special elements or assemblies for zero gap configurations or solid polymer electrolyte membranes may be used. Also, the units of the present invention may be adapted for a gas chamber for use in conjunction with a gas-consuming electrode, sometimes called a depolarized electrode. The gas chamber is required in addition to the liquid electrolyte compartments. A variety of cell elements which may be used in the present invention are well known to those skilled in the art and are shown in a variety of patents, for example, U.S. Pat. Nos. 4,457,823; 4,457,815; 4,444,623; 4,340,452; 4,444,641; 4,444,639; 4,457,822; and 4,448,662.

Preferably, the flat surfaces of the electrode components 36, 36A, 46, or 46A have their edges rolled inwardly toward the central support element 17 and away from the ion exchange active membrane 27 and 27A. This is preferably done to prevent the sometimes jagged edges of these electrode compartments 36, 36A, 46, or 46A from contacting the ion exchange active membrane 27 and 27A and tearing it.

The unlined electrolytic unit 10 and the lined electrolytic unit 11 of the present invention may be prepared in a variety of ways using a variety of elements. There are however, three main categories of elements used in making the electrolytic units of the present invention:

(1) central support element 17;

(2) peripheral flange structures 16, 96, and 97; and (3) bosses 18 and 18A.

Within each of these categories, each element may be composed of a plurality of pieces. For example, the central support element 17 may be a plurality of pieces joined together. Likewise, the peripheral flange structure may be a plurality of pieces joined together. Similarly, the bosses 18 and 18A may be one piece units that pass through the central support element 17, or they may be partial bosses 18 and 18A which do not pass through the central support element 17, but are merely attached to one surface thereof.

The three types of elements are combined in a manner to form the electrolytic unit described herein, but, as can be seen, there are a variety of sequences that may be followed in assemblying the three types of elements to form an electrolytic unit. For example, the elements may be assembled by, first, attaching the bosses 18 and 18A to the central support element 17 and then attaching the peripheral flange structures 16, 96, and 97 to the periphery of the central support element 17. Or, another sequence may be used in which the peripheral flange structures 16, 96, and 97 are first attached to the central support element 17 and then the bosses 18 and 18A are attached.

Another method for assemblying the electrolytic units of the present invention is by preparing (for example by casting) the elements into subcombinations, followed by attaching the remaining elements to the subassembly. For example, a unitized central support element 17 having at least a portion of the bosses 18 and 18A may be formed by casting. Then, the remaining portion of the bosses 18 and 18A, if any, and the peripheral flange structures 16, 96, and 97 may be attached. Optionally, a unitized central support element 17 having at least a portion of the bosses 18 and 18A may be formed by casting. Then, the peripheral flange structures 16, 96, and 97 may be attached, followed by the bosses 18 and 18A being attached.

To assure that the unlined electrolytic unit 10 or lined electrolytic unit 11 of the present invention are as a planar as possible, it is optional to flatten the surfaces of the assembled, or partially assembled, electrolytic units. The electrolytic unit may be flattened at any one, or more, of the various steps of assembly of the electrolytic unit. For example, it may be flattened:

after all of the bosses 18 and 18A have been attached to one side of the central support element 17;

after only a portion of the bosses 18 and 18A have been attached to the central support element 17;

after all or a portion of the bosses 18 and 18A have been attached to the central support element 17 but before the periheral flange structures 16, 96, and 97 have been attached; or after all the bosses 18 and 18A and the peripheral flange structures 16, 96, and 97 have been attached.

The electrolytic unit of the present invention may be flattened using a variety of techniques well known to those skilled in the art, such as abrasive belt grinding, and mechanical milling. Preferably, the finished unlined electrolytic unit 10 or lined electrolytic unit 11 is sufficiently flattened such that when two unlined or unlined electrolytic units are mated with each other in operable combination, the number of leaks is minimized. For use in chlor-alkali electrochemical cells, it is most preferred for the unlined electrolytic unit 10 or lined electrolytic unit 11 to have a flatness deviation of less than about 0.4 millimeters (0.015 inch) throughout its entire mass.

Attaching the bosses 18 and 18A to the central support element 17 may be done using a variety of techniques. For example, the central support element 17 may be cast as a solid unit and later have holes drilled and tapped through its thickness, or partially through its thickness. The bosses 18 and 18A can be threaded and then screwed into the holes in the central support element 17 from both sides. Optionally, the bosses 18 and 18A can be threaded through half their length and they can be screwed half way through the central support element 17. Preferably, the ends of the bosses 18 and 18A are machined flattened before they are attached to the central support element 17.

Another way for attaching the bosses 18 and 18A is by welding. Preferably, the bosses 18 and 18A and the central support element 17 are made from materials that are weldably compatible. If the two materials are not weldably compatible, an intermediate material, weldably compatible with both materials, may be inserted between the two materials. Preferably, the bosses 18 and 18A are welded slowly so the warpage of the central support element 17 caused by the heat of the welding is minimized. Conveniently, the central support element 17 is held flat during welding.

The peripheral flange structure 16, 96, and 97 may be a single, picture frame type structure or it may be a plurality of pieces joined together to form a complete covering around the peripheral edges of the central support element 17. The peripheral flange is thicker than the central support element 17. However, its surfaces 16A and 16C lie in approximately the same plane as do the ends of the bosses 18 and 18A after the bosses have been attached to the central support element 17 and flattened. Preferably, the peripheral flange structures 16, 96, and 97 and the central support element 17 are made from materials that are weldably compatible. Otherwise, an intermediate material, weldably compatible with both materials, may be positioned between the two materials. If it is composed of pieces, the pieces may be attached to the central support element 17 before or after the bosses 18 and 18A are attached to the central support element 17. The combination may be flattened before or after the peripheral flange structures 16, 96, and 97 are attached to the central support element 17.

If desired, a liner 26 or 26A may be positioned over only the area of the electrolytic unit which will be contacted with corrosive environments when the electrolytic unit is used in electrolytic processes. Optionally, the peripheral flange structures 16, 96, and 97 may also be lined, even though they may not be exposed to a corrosive environment. Optionally, a liner 26 or 26A may be positioned on only one side of the central support element 17 or on both sides of the electrolytic unit. The liner 26 or 26A may be one piece or, it may be a plurality of pieces bonded together. It should, however, be of a substantially completely hydraulically impermeable construction.

The liner 26 or 26A may be coextensive with the central support element 17, or it may be coextensive with the entire length and width of the entire central support element 17 and the peripheral flange structures 16, 96, and 97.

When a plurality of unlined electrolytic units 10, lined electrolytic units 11, or a combination of unlined electrolytic units 10 and lined electrolytic units 11 are assembled adjacent to each other, gaskets 44 are preferably positioned between adjacent electrolytic units. Gaskets serve three main functions: sealing electrical insulation and setting, and maintaining, the electrode gap. There are a variety of suitable gasket 44 materials that may be suitably used, for example, ethylenepropylenediene terpolymer, chlorinated polyethylene, polytetrafluoroethylene, perfluoroalkoxy resin.

Adjacent to the central support element 17, or the liner 26 or 26A, if liners 26 or 26A are used, is an electrode component 36, 36A, 46, or 46A. The electrode components 36, 36A, 46, or 46A may be attached to the liner 26 or 26A; central support element 17; or merely pressed against the liner 26 or 26A or the central support element 17.

Preferably, the electrode component is coextensive with the central support element 17 and does not extend into the peripheral flange structure area. Otherwise, it would be difficult to seal adjacent unlined electrolytic units 10 or lined electrolytic units 11 when they are placed in operation combination.

A particularly suitable way for fabricating a unit of the present invention is using a flat workpiece upon which to support the central support element which has previously had holes drilled and tapped in it to receive the bosses. A plurality of bosses are cut to equal length and have a threaded portion cut into their center. They have unthreaded portions extending from the threaded portion. These extensions are of differing diameters. The smaller diameter portion has been designed to be smaller than the diameter of the hole drilled in the central support element. The smaller end of the bosses are passed through the hold and until the threaded portion of the boss contacts the threaded portion of the hole. Then, the bosses are screwed into the central support element until they touch the flat workpiece. In this manner, it is easy to make sure all the bosses extend the same length from the central support element.

In operating the cell series for the electrolysis of NaCl brine to produce chlorine and caustic, certain operating conditions are generally used. In the anolyte compartment, a pH of from about 0.5 to about 5.0 is desired to be maintained. The feed brine preferably contains only minor amounts of multivalent cations (less than about 80 ppb of brine when expressed as calcium). More multivalent cation concentration is tolerated with the same beneficial results if the feed brine contains carbon dioxidein concentrations lower than about 70 parts per million when the pH of the feed brine is lower than about 3.5. Operating temperatures can range from about 0° C. to about 250° C., but are preferably above about 60° C. Brine purified from multivalent cations by ion-exchange resins after conventional brine treatment has occurred is particularly useful in prolonging the life of the membrane. A low iron content in the feed brine is desired to prolong the life of the membrane. Preferably the pH of the brine feed is maintained at a pH below 4.0 by the addition of hydrochloric acid.

Preferably, the pressure in the catholyte compartment is maintained at a pressure slightly greater than that in the anolyte compartment, but preferably at a pressure different which is no greater than a head pressure of about 1 foot of water. Preferably, the operating pressure of the cell is maintained at less than about 7 atmospheres.

Usually the cell is operated at a current density of from about 1.0 to about 4.0 amperes per square inch, but in some cases operating above 4.0 amps per square inch is quite acceptable.

EXAMPLE 1

A four feet (122 centimeters) by 8 feet (244 centimeters) bipolar, flat plate filter press type ion exchange membrane cell was constructed as follows.

A four feet (122 centimeters) by 8 feet (244 centimeters) steel plate, ½ inch (1.27 centimeters) thick was drilled and tapped so it had one hundred sixteen, 1 inch (25 millimeters) holes in it, in a square pattern. The steel plate was used as the central support element and had welded around its periphery a ¾ inch (19 millimeters) thick, 2¾ inch (70 millimeters) wide low carbon steel picture frame type peripheral flange structure.

A plurality of 1 inch (25 millimeters) threaded steel rods were screwed firmly into each of the 116 holes. On the side destined to become the anode side, a vanadium wafer was positioned over the end of each rod and a titanium cap was then placed over the rod and vanadium wafer. The cap was welded to each of the 116 rods, through the vanadium wafer. On the side destined to become the cathode side, a nickel cap was placed over and welded to each of the 116 rods. Since nickel can be relatively easily welded to steel, no intermediate wafer was needed on the cathode side. The vanadium wafer was about 0.005 inch (0.13 millimeters) thick. The cap was about 0.035 inch (0.9 millimeter) thick.

For corrosion protection, the anode compartment was lined with a 0.035 inch (0.9 millimeter) thick titanium liner which was made of a flat titanium sheet welded to a U-shaped titanium side cover on all four peripheral sides. The titanium liner had 116 holes concentric to the holes on the central support element for fitting over the connector rods. The titanium liner was welded to the titanium cap on the connector.

The cathode compartment was lined with a 0.060 inch (1.5 millimeters) thick nickel liner which was made of a flat nickel sheet welded to a U-shaped nickel side covers on the peripheral sides. The nickel liner also had 116 holes concentric to the holes on the central support element for fitting over the connector rods. The nickel liner was welded around each nickel cap.

The anode was a 0.063 inch (1.6 millimeters) thick, 40% open, expanded titanium mesh with a diamond pattern of 0.025 inch (0.65 millimeter) SWD by 0.050 inch (1.3 millimeters) LWD. The anode was resistance welded to the titanium caps on top of connectors on the anode side.

The cathode was made of nickel mesh of the same specifications as the titanium mesh. The cathode was resistance welded to nickel caps on top of connectors on the cathode side.

A ½ inch (13 millimeters) diameter titanium pipe was welded to the titanium liner through a hole at the bottom left of the anode compartment for the brine inlet. Another ¾ inch (19 millimeters) diameter pipe was welded to the titanium liner through a hole at the top right of the anode compartment for the brine and chlorine gas outlet. Similarly, nickel pipes were welded to the cathode compartment for a catholyte inlet and outlet.

The cell was built so that the anode mesh receded about 0.015 inch (0.4 millimeter) below the titanium side gasket flange and the cathode mesh receded about 0.035 inch (0.9 millimeter) below the nickel side gasket flange. With an expanded polytetrafluoroethylene gasket of about 0.050 inch (1.3 millimeters) compressed thickness between the membrane and the cathode gasket flange and no gasket between the membrane and the anode gasket flange, the nominal inter-electrode gap was about 0.100 inch (2.5 millimeter).

EXAMPLE 2

Four (4) electric current transmission elements were cast for a nominal 61 cm (2 feet) by 61 cm (2 feet) monopolar electrolyzer.

All electric current transmission elements were cast of ASTM A536, GRD65-45-12 ductile iron and were identical in regard to as-cast dimensions. Finished castings were inspected and found to be structurally sound and free of any surface defects. Primary dimensions included: nominal 61 cm (24 in.) by 61 cm (24 in.) outside dimensions, a 2 cm (0.80 in.) thick central barrier 16, 2.5 cm (one in.) diameter bosses located on each side of the central barrier and directly opposing each other, a 2.5 cm (one in.) wide sealing means area 6.4 cm (2.5 in.) thick around the peripheral of the cell casting. Machined areas included the sealing means faces (both sides parallel) and the top of each boss (each side machined in a single plane and parallel to the opposite side). There were sixteen bosses on each side.

The cathode cell incorporated 0.9 mm (0.035 in.) thick protective nickel liners on each side of the cell structure. Inlet and outlet nozzles, also constructed of nickel were prewelded to the liners prior to spot welding the liners to the cell structure. Final assembly included spot welding catalytically coated nickel electrodes to the liners at each boss location.

The distance between the planes of the ends of the bosses was 2.290 inches for the monopolar cathode cell, which may be called the central support element thickness. The overall cell thickness, from the outside of one nickel electrode component to the outside of the other nickel electrode component was 2.726 inches. Thus, the support element thickness was 92% of the total thickness.

The cathode terminal cell was similar to the cathode cell with the exception that a protective nickel liner was not required on one side, as well as the lack of an accompanying nickel electrode.

The anode cell incorporated 0.9 mm (0.035 in.) thick protective titanium liners on each side of the cell structure. Inlet and outlet nozzles, also constructed of titanium were prewelded to the liners prior to spot welding the liners to the cell structure. Final assembly included spot welding titanium electrodes to the liners at each boss location through an intermediate of vanadium metal. The anodes were coated with a catalytic layer of mixed oxides of ruthenium and titanium.

The anode terminal cell was similar to the anode cell with the exception that a protective titanium liner was not required on one side, as well as the lack of an accompanying titanium electrode.

We claim:

1. A method for making an electrolytic unit having
a substantially planar central support element;
a plurality of bosses on each side of the central support element projecting outwardly from and contacting the central support element; and
a peripheral flange structure composed of at least one piece and having an internal surface which sealably receives all external peripheral edges of the central support element;
said method comprising:
(a) forming a unitized, planar subassembly of the central support element and at least a portion of the peripheral flange structures;
(b) attaching any remaining peripheral flange structures to complete the peripheral flange structure desired for at least one side of the central support element;
(c) completing, as required, the assembly of the electrolytic unit by attaching any elements remaining in the group consisting of peripheral flange structures and any remaining bosses desired on the opposing side of the central support element;
(d) covering at least a portion of at least one of the boss-containing sides of the central support element with a metal liner composed of one or more pieces; and
(e) attaching said metal liner(s) to at least a portion of the bosses contacting the metal liner by welding or diffusion bonding.

2. The method of claim 1 wherein the metal liner is attached to all of the ends of the bosses by welding.

3. The method of claim 1 wherein the central support element is made from the group of materials selected from the group consisting of iron, grey iron and malleable iron, ductile iron, steel, stainless steel, nickel, aluminum, molybdenum, copper, magnesium, lead, alloys of each and alloys thereof.

4. The method of claim 1 wherein the bosses are made from the group of materials selected from the group consisting of iron, grey iron and malleable iron, ductile iron, steel, stainless steel, molybdenum, nickel, aluminum, copper, magnesium, lead, alloys of each and alloys thereof.

5. A method for making an electrolytic unit having
a substantially planar central support element;
a plurality of bosses on each side of the central support element projecting outwardly from and contacting the central support element; and
a peripheral flange structure composed of at least one piece and having an internal surface which sealably receives all external peripheral edges of the central support element;
said method comprising:
(a) forming a utilized, planar subassembly of the central support element and at least a portion of the bosses;

(b) attaching any remaining bosses;

(c) completing, as required, the assembly of the electrolytic unit by attaching the peripheral flange structures by welding;

(d) covering at least a portion of at least one of the boss-containing sides of the central support element with a metal liner composed of one or more pieces; and (e) attaching said metal liner(s) to at least a portion of the bosses contacting the metal liner.

6. The method of claim 5 wherein the liner is attached to the ends at least a portion of the bosses by welding or diffusion bonding.

7. The method of claim 5 wherein the metal liner is attached to all of the ends of the bosses by welding or diffusion bonding.

8. The method of claim 5 wherein the central support element is made from the group of materials selected from the group consisting of iron, grey iron and malleable iron, ductile iron, steel, stainless steel, nickel, aluminum, molybdenum, copper, magnesium, lead, alloys of each and alloys thereof.

9. The method of claim 5 wherein the bosses are made from the group of materials selected from the group consisting of iron, grey iron and malleable iron, ductile iron, steel, stainless steel, molybdenum, nickel, aluminum, copper, molybdenum, magnesium, lead, alloys of each and alloys thereof.

10. A method for making an electrolytic unit having a substantially planar central support element;

a plurality of bosses on each side of the central support element projecting outwardly from and contacting the central support element; and a peripheral flange structure composed of at least one piece and having an internal surface which sealably receives all external peripheral edges of the central support element;

said method comprising:

(a) forming a unitized, planar subassembly of the central support element, at least a portion of the peripheral flange structures and at least a portion of the bosses;

(b) attaching, by welding, any remaining peripheral flange structures and any remaining bosses to complete the peripheral flange structure desired for at least one side of the central support element;

(c) covering at least a portion of at least one of the boss-containing sides of the central support element with a metal liner composed of one or more pieces; and (d) attaching said metal liner(s) to at least a portion of the bosses contacting the metal liner.

11. The method of claim 10 wherein the liner is attached to the ends of at least a portion of the bosses by welding or diffusion bonding.

12. The method of claim 10 wherein the metal liner is attached to all of the ends of the bosses by welding or diffusion bonding.

13. The method of claim 5 wherein the central support element is made from the group of materials selected from the group consisting of iron, grey iron and malleable iron, ductile iron, steel, stainless steel, nickel, aluminum, molybdenum, copper, magnesium, lead, alloys of each and alloys thereof.

14. The method of claim 10 wherein the bosses are made from the group of materials selected from the group consisting of iron, grey iron and malleable iron, ductile iron, steel, stainless steel, molybdenum, nickel, aluminum, copper, molybdenum, magnesium, lead, alloys of each and alloys thereof.

15. A method for making an electrolytic unit having a substantially planar central support element;

a plurality of bosses on each side of the central support element projecting outward from the central support element and positioned between, and contacting, the central support element; and a peripheral flange structure composed of at least one piece and having an internal surface which sealably receives all external peripheral edges of the central support element;

said method comprising:

(a) forming, by casting, die casting, powdered metal pressing and sintering, hot isostatic pressing, hot forging or cold forging, a unitized, planar subassembly of a portion of the central support element, at least a portion of the peripheral flange structures and at least a portion of the bosses;

(b) forming, by casting, die casting, powdered metal pressing and sintering, hot isostatic pressing, hot forging or cold forging, a unitized, planar subassembly of the remaining portion of the central support element, at least a portion of the peripheral flange structures and at least a portion of the bosses;

(c) connecting the central support elements;

(d) attaching any remaining peripheral flange structures and any remaining bosses to complete the peripheral flange structure desired for at least one side of the central support element;

(e) covering at least a portion of at least one of the boss-containing sides of the central support element with a metal liner composed of one or more pieces; and (f) attaching said metal liner(s) to at least a portion of the bosses contacting the metal liner by welding or diffusion bonding.

16. The method of claim 15 wherein the peripheral flange structures are attached by welding.

17. The method of claim 15 wherein the metal liner is attached to all of the ends of the bosses by welding or diffusion bonding.

18. The method of claim 15 wherein the central support element is made from the group of materials selected from the group consisting of iron, grey iron and malleable iron, ductile iron, steel, stainless steel, nickel, molybdenum, aluminum, copper, magnesium, lead, alloys of each and alloys thereof.

19. The method of claim 15 wherein the bosses are made from the group of materials selected from the group consisting of iron, grey iron and malleable iron, ductile iron, steel, stainless steel, molybdenum, nickel, aluminum, copper, molybdenum, magnesium, lead, alloys of each and alloys thereof.

* * * * *

UNITED STATES PATENT AND TRADEMARK OFFICE

CERTIFICATE OF CORRECTION

PATENT NO. : 4,673,479

DATED : June 16, 1987

INVENTOR(S) : Gregory J.E. Morris, Sandor Grosshandler, Richard N. Beaver, John R. Pimlott and Hiep D. Dang It is certified that error appears in the above-identified patent and that said Letters Patent is hereby corrected as shown below:

Col. 4, line 31; change "38A" to --36A--.

Col. 9, line 20; insert a space between "liner" and "and" thus "linerand" reads as --liner and--.

Col. 9, line 25; change "techniques" to --technique--.

Col. 11, line 15; change "compartments" to --components--.

Col. 13, line 44; change "operation" to --operable--.

Col. 14, line 3; insert a space between "dioxide" and "in" thus "dioxidein" reads as --dioxide in--.

Col. 16, line 66, Claim 5; change "utilized" to --unitized--.

Col. 17, line 60, Claim 13; change "5" to --10--.

Signed and Sealed this

Twenty-ninth Day of March, 1988

*Attest:*

DONALD J. QUIGG

*Attesting Officer*

*Commissioner of Patents and Trademarks*